US005987769A

United States Patent [19]

Ackerman et al.

[11] Patent Number: 5,987,769

[45] Date of Patent: Nov. 23, 1999

[54] CENTRIFUGAL DRYER

[75] Inventors: Kyle D. Ackerman, Dassel; David A. Hauch, Afton, both of Minn.

[73] Assignee: Carter Day International, Inc., Minneapolis, Minn.

[21] Appl. No.: 08/641,212

[22] Filed: Apr. 30, 1996

[51] Int. Cl.[6] ..... F26B 17/24

[52] U.S. Cl. ..... 34/58; 34/312; 34/167; 210/261; 210/257.1

[58] Field of Search ..... 34/58, 59, 60, 34/166, 167, 349, 350; 210/770, 261, 262, 257.1

[56] References Cited

U.S. PATENT DOCUMENTS 5,265,347 11/1993 Woodson et al. ..... 34/58

5,611,150 3/1997 Yore, Jr. ..... 34/58

*Primary Examiner*—Henry A. Bennett

*Assistant Examiner*—Pamela A. O'Connor

[57] ABSTRACT

There is provided an improved centrifugal dryer that includes a motor section or portion, a dryer section or portion disposed therebelow, and a reservoir section or portion disposed below the dryer portion, the dryer portion being hingedly attached to the reservoir portion. A product slurry is introduced into the dryer portion through a center inlet pipe and flows into the dryer section where the product is dried by forcing the fluid in the slurry through apertures in a perforated screen held in position between upper and lower screen positioning plates.

35 Claims, 6 Drawing Sheets

CENTRIFUGAL DRYER

FIELD OF THE INVENTION

The present invention relates generally to equipment used to dry particulate matter contained within a slurry and in particular to apparatus used to dry particulate matter contained within a water based slurry.

BACKGROUND OF THE PRESENT INVENTION

Raw plastics manufacturers produce a liquid product that is extruded in a tubular form from an extruder. The product is extruded under water and then cut into small pieces, tending to form generally spherically shaped particles or beads as it cools. This plastic bead/water slurry is then transported to a dryer to remove the water from the plastic product so that the product can be shipped to other manufacturers to manufacture useful products.

Before shipment, the raw plastic product must be dried. This has been accomplished in the past with the use of centrifugal dryers. Such dryers are known in the art. Typically they comprise a unitary structure formed from many individually welded parts making disassembly and cleaning quite time consuming, labor intensive, and often difficult.

SUMMARY OF THE INVENTION

It is an object of the present invention to provide new and improved apparatus that is not subject to the foregoing disadvantages.

It is another object of the present invention to provide an improved centrifugal dryer that is more easily cleaned than prior art centrifugal dryers.

It is still another object of the present invention to provide an improved centrifugal dryer that allows for removal and cleaning of the screens without the use of tools.

It is yet another object of the present invention to provide an improved centrifugal dryer that includes a center inlet into the dryer rather than a side inlet as known in the prior art to increase the amount of suction, to reduce the work of the motor and provide for a more efficient initial water discharge.

It is still yet another object of the present invention to provide an improved centrifugal dryer having a hinged dryer section or portion to allow for changing or cleaning of the dryer screen and cleaning of the dryer and reservoir.

It is another object of the present invention to allow access to a silt screen disposed within the dryer reservoir without tools for repair, cleaning or replacement thereof.

It is still yet another object of the present invention to provide a centrifugal dryer having a rotor attached for rotational motion at only one end to facilitate a tool-less access to the interior of the dryer.

The foregoing objects of the present invention are provided by an improved centrifugal dryer that includes a motor section or portion, a dryer section or portion disposed therebelow, and a reservoir section or portion disposed below the dryer portion, the dryer portion being hingedly attached to the reservoir portion. A product slurry is introduced into the dryer portion through a center inlet pipe and flows into the dryer section where the product is dried.

A dryer in accord with the present invention may have a reservoir section that has a reservoir top plate with the dryer section being hingedly attached thereto. The dryer section may further have a canister having a canister bottom plate mounted thereto and a perforated screen mounted therein, the dryer section further having a bottom pan removably attached to said the canister bottom plate. The canister rotatably mounts therein a rotor having a plurality of rows of rotor blades mounted thereon, the rotor being mounted within a substantially cylindrically configured perforated screen mounted in the canister. The screen may be held between upper and lower screen positioning plates and may be insertable and removable therefrom without the use of tools. To aid in the cleaning, maintenance and repair of the present invention the bottom canister bottom plate may mount a plurality of locator pins and the bottom pan may include a plurality of locating apertures configured to receive the locator pins and removably attach the bottom pan to the canister bottom plate. Removal of the bottom pan thus exposes the interior of the canister, including the screen and rotor for maintenance and repair.

To reduce the level of work that the motor driving the rotor must provide the bottom pan may include a throat disposed substantially in the center thereof that receives the outlet of the slurry inlet pipe, thus providing a center inlet in contrast to known prior art centrifugal dryers that operate with a side inlet for the product slurry.

The foregoing objects of the invention will become apparent to those skilled in the art when the following detailed description of the invention is read in conjunction with the accompanying drawings and claims. Throughout the drawings, like numerals refer to similar or identical parts.

BRIEF DESCRIPTION OF THE DRAWINGS

FIG. 8 shows the present invention with the dryer section pivotally rotated relative to the reservoir section with the bottom pan shown assembled to the canister bottom plate and the silt screen shown positioned for insertion into the reservoir section of the present invention.

DETAILED DESCRIPTION OF THE INVENTION

Figure 1:
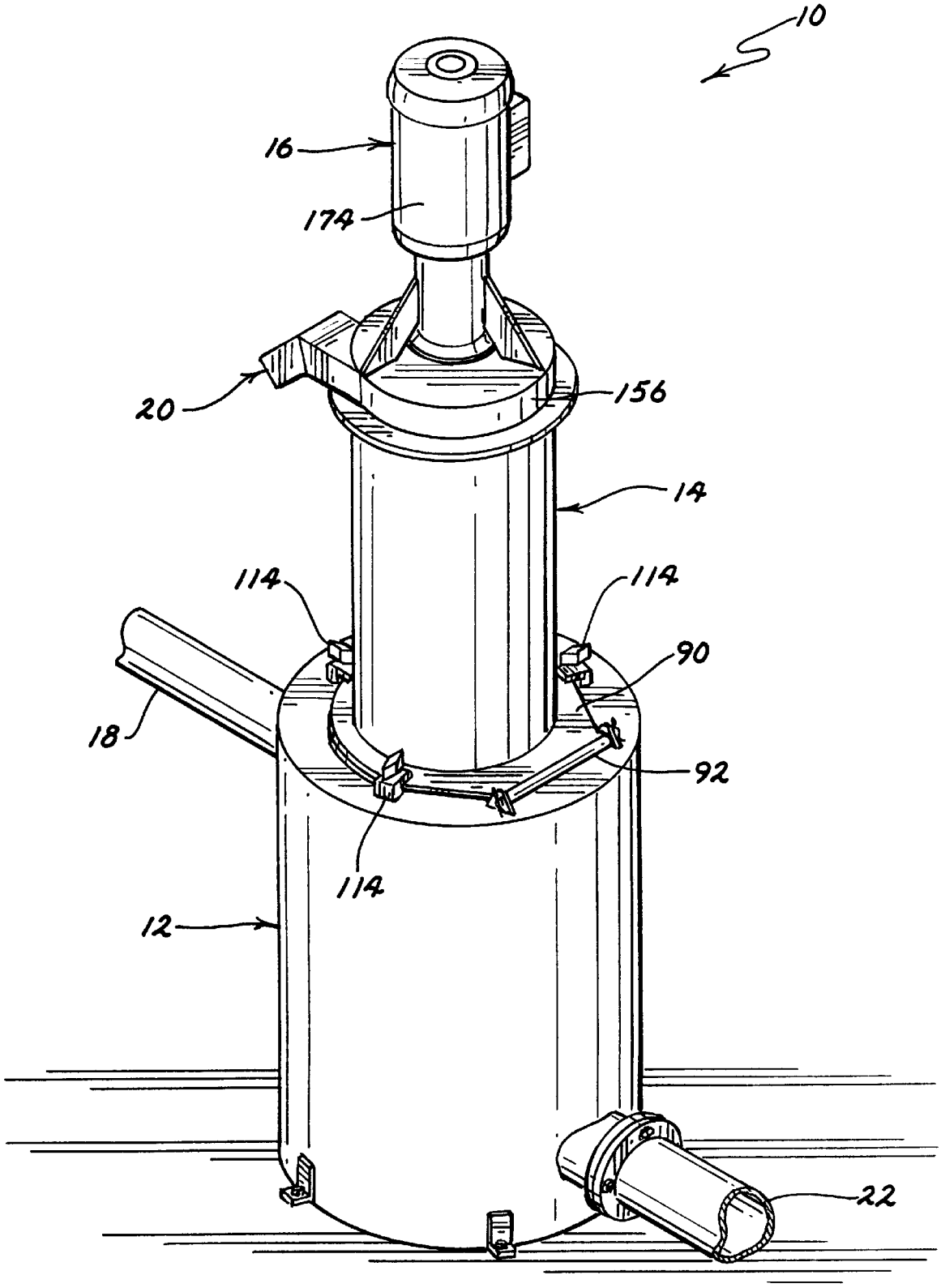
FIG. 1 illustrates a centrifugal dryer in accord with the present invention in a perspective view.

A centrifugal dryer in accord with the present invention 10 is shown in a perspective view in FIG. 1. Dryer 10 includes a reservoir section 12, a dryer section or portion 14, and a motor section or portion 16. A product slurry, such as a plastic bead or sphere/water mixture, is introduced into the dryer 10 by means of an inlet pipe 18. As seen in the Figures, inlet pipe 18 introduces the product slurry into the center of the dryer section and along the axis of rotation of the rotor.

Known prior art dryers utilize a side inlet for the slurry that introduces a slurry flow into the dryer section substantially transverse to the axis of rotation of the rotor. The center inlet of slurry provides additional suction and capacity, making the operation of the motor more efficient and providing a more efficient initial water discharge from the product. Dried product is removed from the dryer 10 through a product discharge chute 20 while water removed from the dried product is removed from the reservoir 12 through an outlet pipe 22.

Figure 2:
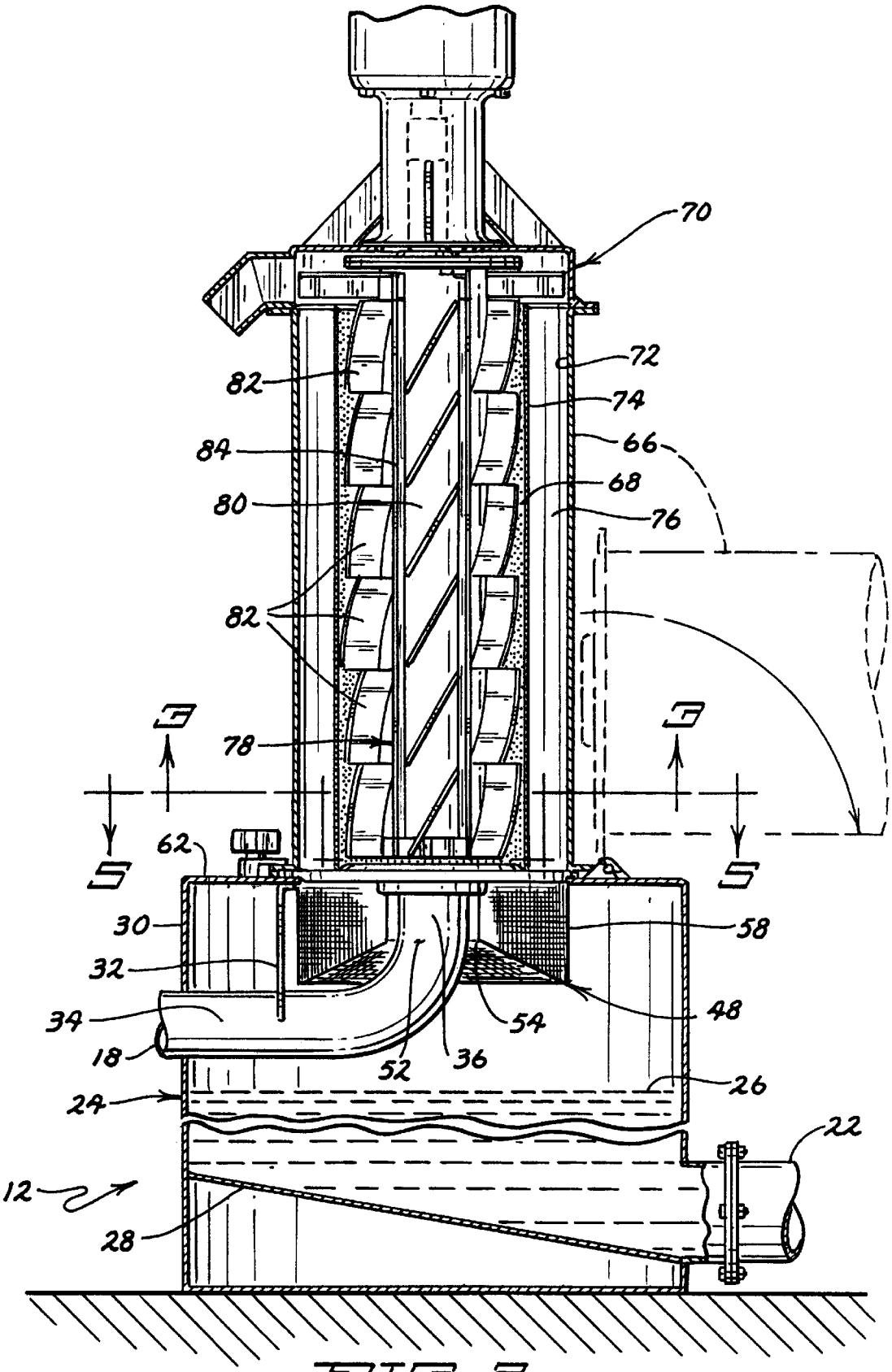
FIG. 2 shows a side elevation, cross sectional view of the invention shown in FIG. 1.

Referring now to FIGS. 1 and 2 principally, it will be seen that the dryer section 14 is hingedly attached to the reservoir section 12. This hinged connection, as well as other features to be discussed further herein, enables the dryer section 14 to be pivoted about a hinge pin or rod so as to expose the bottom of the dryer section 14 and to facilitate cleaning, removal, or replacement of the drying screen, cleaning of the reservoir, and cleaning of the dryer section itself.

Referring now to FIG. 2, it will be observed that the reservoir section comprises a tank 24 for holding, at least temporarily, water 26 removed from the product during the drying process. The water 26 may be removed from the tank 26 through the water discharge pipe 22 and recycled for further use in the product slurry or cleaned as necessary and discharged back into the available sewage system. Tank 24 may include a sloped bottom 28 to facilitate removal of water or other materials from the tank as necessary.

It will be observed in FIG. 2 that the slurry inlet pipe 18 enters reservoir tank 24 through the side wall 30 thereof into the interior of the tank 24 where it is supported by an inlet support plate 32. The inlet pipe 18 then bends upwardly at an angle of approximately 90° as shown. Thus, within the tank 24 the inlet pipe 18 includes a substantially horizontal portion 34 and a substantially upright portion 36. The upright portion 36 and its engagement with the dryer section 14 is shown in greater detail in FIG. 6. The uppermost end of upright portion 36 is fixedly attached in any known manner such as welding to a disk shaped plate or sealing flange 38. Plate or flange 38 has an upper face that engages an o-ring type or other appropriate seal 40, which is disposed between the upper substantially planar surface 42 of sealing flange 38 and a lower surface 44 of the bottom pan 46, seen in FIG. 5 in a top plan view.

Figure 5:
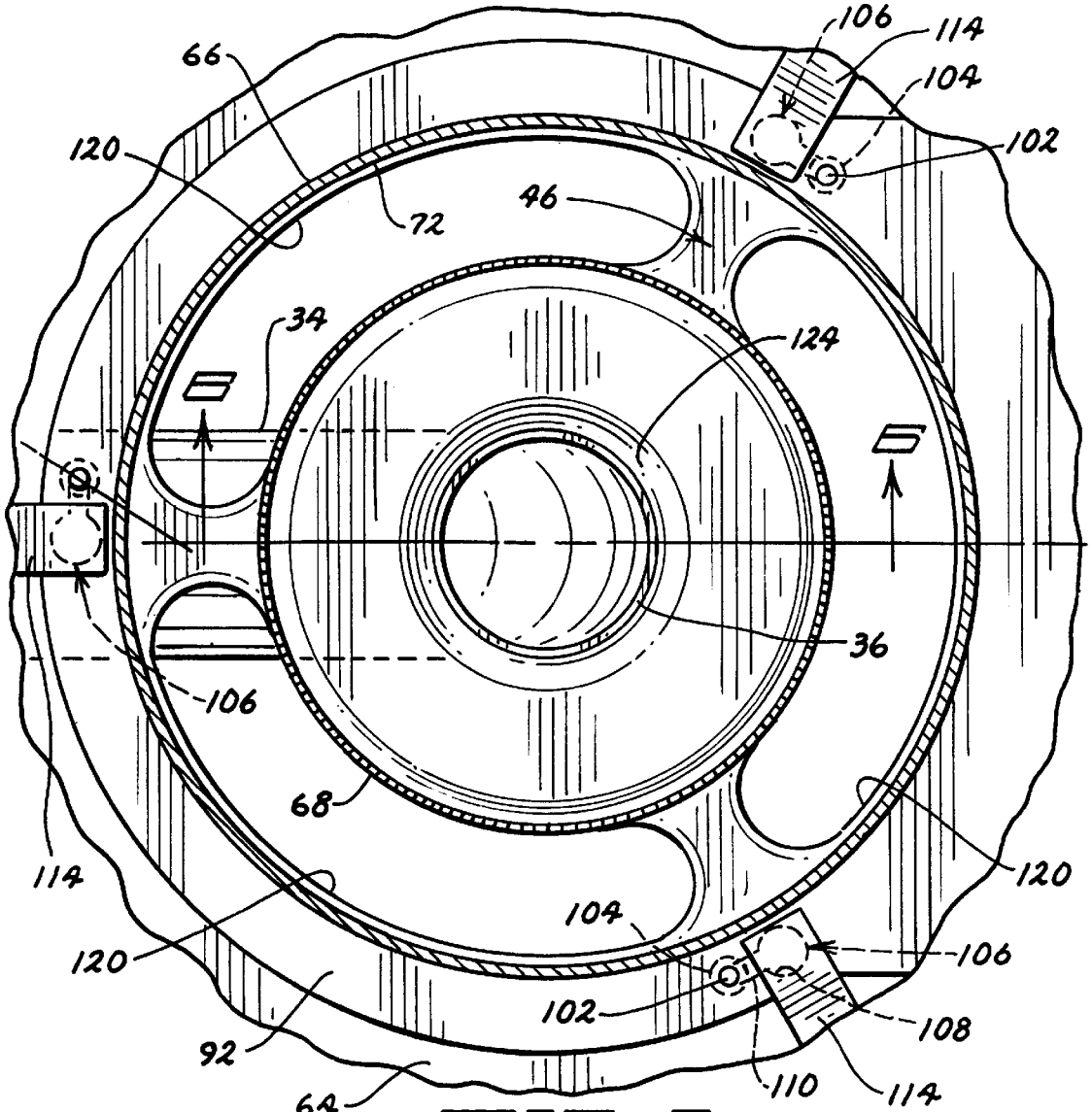
FIG. 5 is a view of the invention shown in FIG. 1 taken along cutting plane 5—5 of FIG. 2.

It will be observed relative to FIGS. 2 and 5 that as the inlet pipe 18 turns upward, it passes through a conically configured silt screen 48. The sloping surface of the silt screen 48 helps prevent the screen apertures from being blinded during operation of the dryer 10. The silt screen 48 includes a cylindrically configured upright portion 50 that engages the outer surface 54 of the sealing flange 38 of inlet pipe 18. That is, the screen upright portion 50 extends upwardly in close or contact proximity to the upright portion 36 of inlet pipe 18 from the narrow or small diameter end 54 of silt screen 48. Stated otherwise, the screen upright portion 50 forms a neck or collar through which the inlet pipe upright portion 36 extends. The screen upright portion 50 is "trapped" between the ring flange 38 and the downwardly extending neck 57 of the bottom pan 46.

At its lower or wide diameter end 56 silt screen 48 is attached to a cylindrically configured member 58. Member 58 includes an outwardly projecting, substantially planar, disk-like flange 60. Cylindrical member 58 has a diameter substantially equal to but slightly less than the diameter $d_{tp}$ of the opening 62 in the top plate 64 of the tank 24. Flange 60, in turn, has an outer diameter greater than $d_{tp}$ of the opening 62 in the tank top plate 64. Thus, silt screen 48 is suspended within reservoir 12 by the flanges 60 engaging the top plate 64.

In this manner, then, when the dryer section 14 is hingeably rotated away from the reservoir, the opening 62 in the tank top plate 64 is exposed. Silt screen 48 can be removed as a unit and cleaned as necessary or replaced. Replacement of the silt screen is simplified by simply having to lower a new silt screen through the opening 62 and suspending the screen 48 by means of flange 60 from the top plate 64. Cleaning and/or repair and replacement of the silt screen is substantially simplified over prior art centrifugal dryer designs.

The basic structure of the reservoir 12 having been described, the dryer section 14 will now be discussed. Referring now to FIG. 2, it will be observed that the dryer section 14 comprises the bottom pan 46, a substantially cylindrically configured canister 66, an inwardly disposed perforated screen 68, and a product discharge housing 70. The inner surface 72 of the canister 66 and the outer surface 74 of the screen 68 are spaced apart to define a tubular shaped volume 76. The canister 66 and the screen 68 each define a longitudinal axis, the axes thereof being substantially co-linear.

A rotor 78 is suspended within the interior of the perforated screen 68 in a manner to be hereafter described. Rotor 78 comprises an elongate, tubular shaped rotor pipe 80. A plurality of rows, as shown, five, of blades 82 are fixedly attached to the rotor pipe 80 in a known manner, such as by welding. A plurality of kickers 84 extend the length of the rotor pipe 80.

Figure 3:
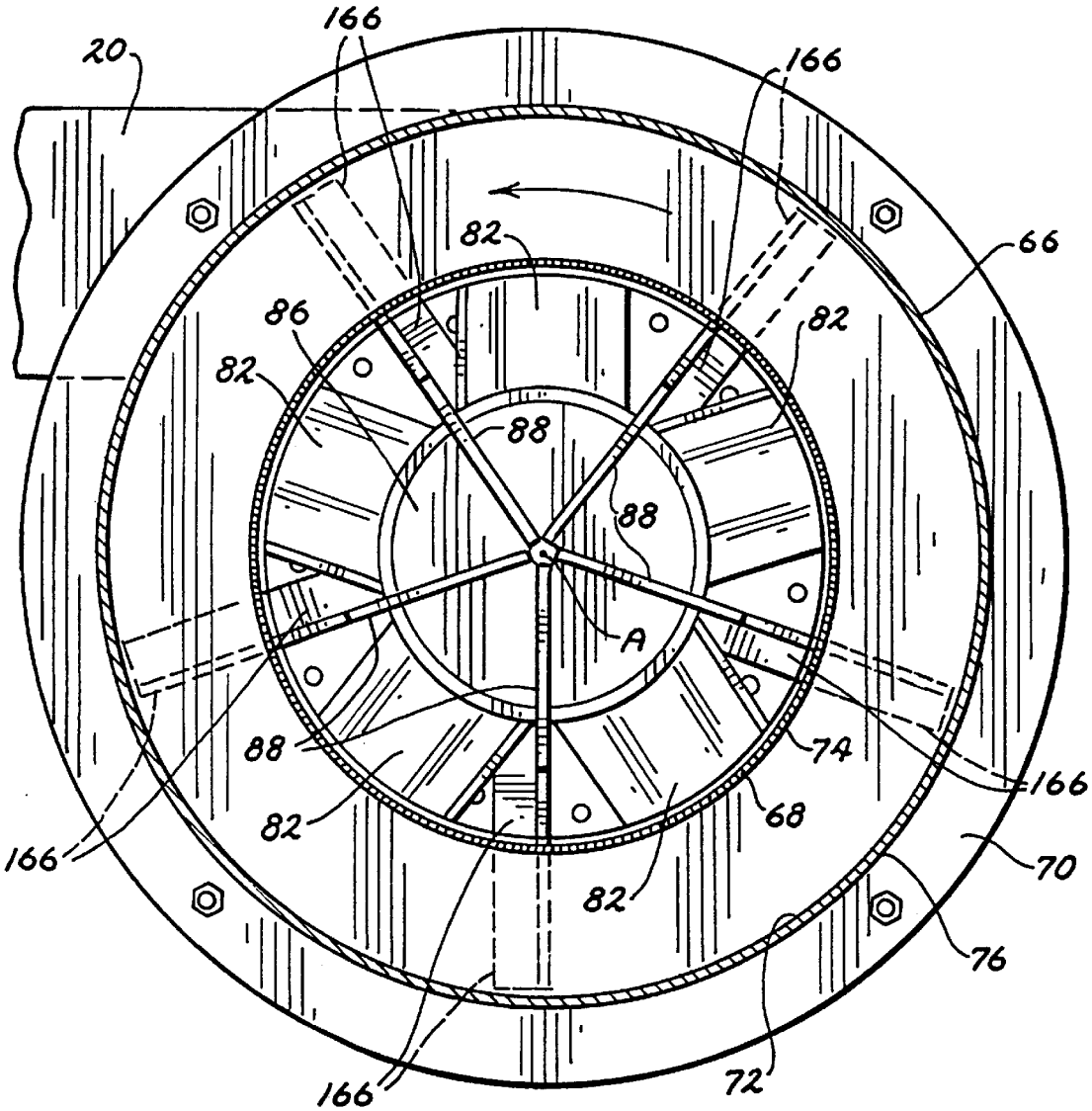
FIG. 3 is a view of the invention shown in FIG. 1 taken along cutting plane 3—3 of FIG. 2.

Referring particularly to FIGS. 2 and 3, the bottom of the rotor 78 will be described. An end plate 86 is attached to the bottom of the rotor 78. End plate 86 comprises a plurality of end plate blades 88 fixedly attached to a rotor bottom plate 90. The rotor bottom plate 90 has a disk like configuration and is configured to attach to and to seal the bottom end of the rotor 78 when attached thereto. End plate blades 88 extend radially outwardly therefrom substantially in alignment with the kickers 84 and the scrapers to be discussed hereafter.

Figure 6:
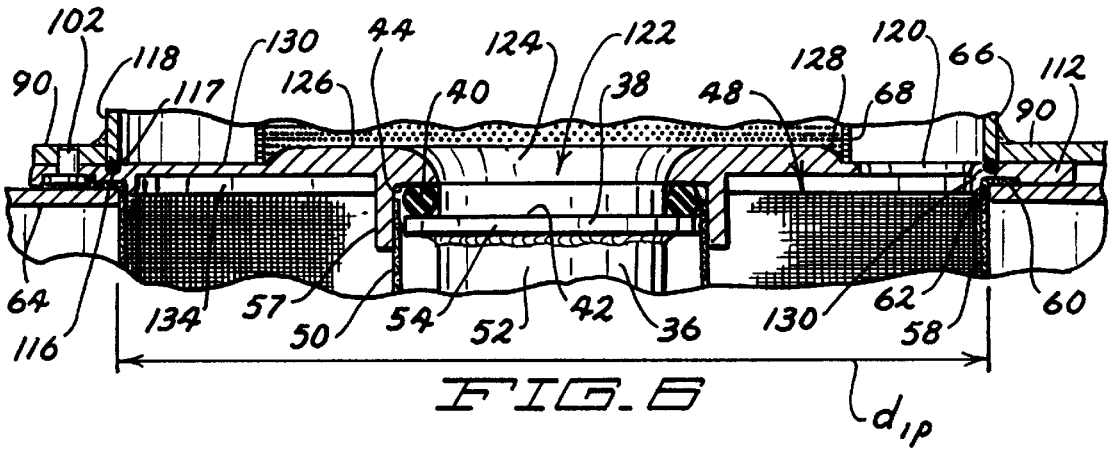
FIG. 6 is a partial cross sectional, side elevation view of the lower end of the dryer section and the upper end of the reservoir section of the present invention taken along cutting plane 6—6 of FIG. 5.
Figure 6:
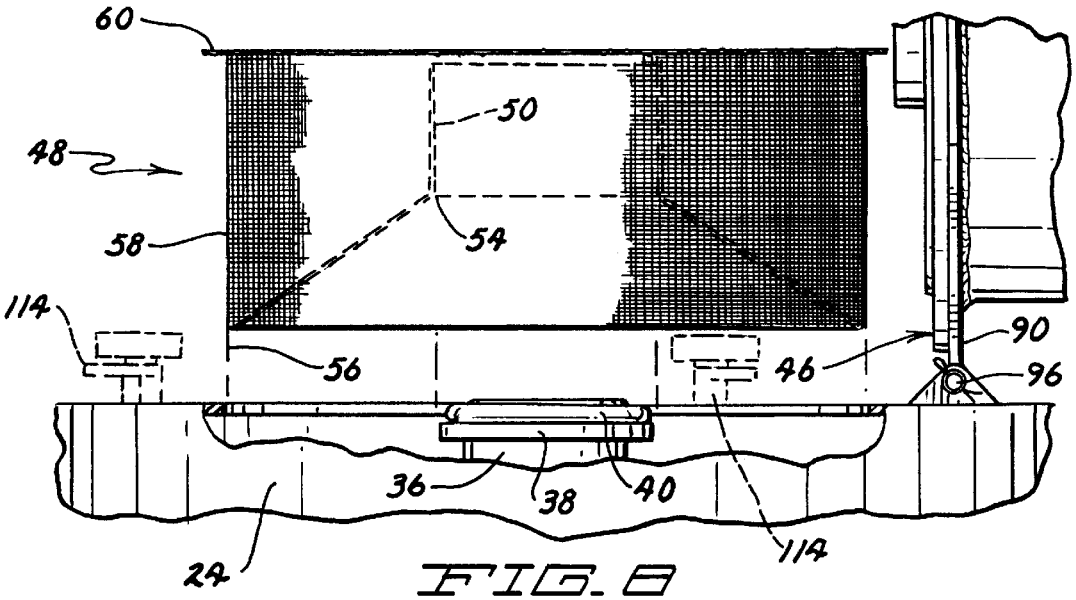
Figure 7:
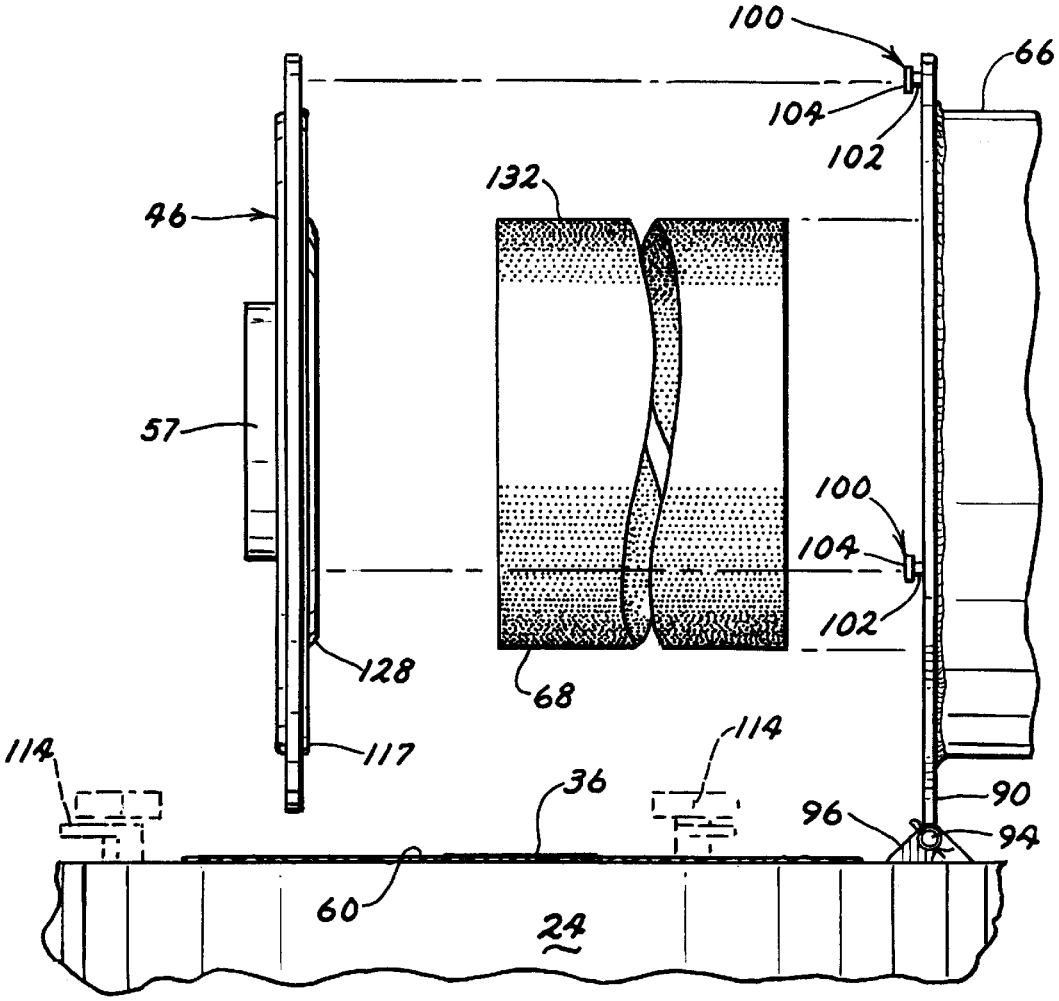
FIG. 7 shows the present invention with the dryer section pivotally rotated relative to the reservoir section with the bottom pan shown disassembled from the canister bottom plate and the perforated screen shown removed therefrom.

Referring to FIGS. 1 and 5–8, it will be observed that canister has a canister bottom plate 90 that is welded or otherwise attached thereto. The canister bottom plate 90 includes a hinge tube 92 that receives a hinge rod 94. The hinge rod 94 has a sufficient length such that it extends through a pair of apertures in hinge ears 96. The hinge rod 94 may be held in place within the hinge tube 92 and hinge ears 96 in any known manner, such as by cotter pins inserted through apertures (not shown) extending through the hinge rod. The hinge ears 96 are attached to the tank top plate 64. As seen in FIGS. 1 and 7–8 particularly, the dryer section 14 and attached motor section 16 can be pivoted about the hinged attachment to the tank top plate 64 to expose the bottom of the canister section and in particular, the bottom pan 46, which is removably attached to the canister bottom plate 90, as will now be explained.

As seen in the Figures, the canister bottom plate 90 includes a plurality of locator pins 100 attached thereto projecting downwardly when the canister 66 has its longitudinal axis vertically oriented. In the present embodiment, three such locator pins 100 are utilized. The locator pins 100 are attached to the canister bottom plate 90 by their shafts 102. Each locator pin 100 includes a head 104, which has, as shown in the Figures, a disk like configuration. Most importantly, the locator pin head 104 has a dimension transverse to the pin shaft axis that exceeds that of the locator pin shaft 102. The locator pins 100 are utilized in the removable attachment of the bottom pan 46 to the canister bottom plate 90. The bottom pan 46 includes a plurality of locking/locating apertures 106. Each locking aperture 106 includes an insertion portion 108 configured to receive a head 104 of a locator pin 100 and a slot portion 110 configured to receive a shaft 102 of a locator pin 100. Thus, to attach the bottom pan 46 to the canister bottom plate 90 the bottom pan 46 is held relative to the bottom plate 90 such that the insertion portions 108 are aligned to receive the heads 104. The bottom pan 46 is then placed against the bottom plate 90 such that the heads 104 of the locator pins 100 extend through the insertion portions 108 and beyond the slot portions 110. The bottom pan 46 is then rotated relative to the canister bottom plate 90 such that the shafts 102 are slidably received within the slot portions 110. The bottom pan 46 is held in place by the heads 104 being unable to pass through the slot portions 110. Referring to FIG. 6 specifically, it will be observed that when the bottom pan 46 is so attached to the bottom plate 90 of the canister 66 that the heads 104 of the locator pins 100 do not project beyond the surface of the flange 112 of the bottom pan 46.

As will be understood from the foregoing description and FIGS. 1, 7 and 8 particularly, The rotatable relationship between the bottom pan 46 and the canister bottom plate 90 facilitates access to the interior of the dryer section 14 for maintenance of the components contained therein. The dryer section 114 is held in place during operation by locking clamps 114. When the clamps 114 are released, which can be done without tools, the dryer section 14 can be pivoted about the hinged attachment provided by the hinge tube 92 and the hinge rod 94 such that the dryer section 14 assumes the relative position shown in phantom in FIG. 1 and FIGS. 7 and 8. Removing the bottom pan 46, which also can be accomplished without tools, allows access to the interior of the dryer section 14 for maintenance and cleaning as needed.

The bottom pan 46 also includes an outwardly disposed circular groove 116 configured to receive a seal 117 and the circular lower end 118 of the canister 66. As the bottom pan 46 is attached to the canister bottom plate 90, seal 117 sealing engages the bottom of the canister 66. Lying circularly thereabout the groove 96 is flange 112. As best seen in the top view of FIG. 5, lying inwardly from the groove 116, and, thus, the canister 66, are a plurality of water discharge holes 120. Holes 120 as seen have the configuration of a circular segment with rounded ends, though other shapes may be used as desired. As shown there are three such holes 120 in bottom pan 46, though more or less may be used as desired. Holes 120 are disposed on bottom pan 46, and therefore directly below volume 76 between the canister 66 and the screen 68. As will be explained in greater detail below, water removed from the slurry will pass through the apertures of the screen and into the volume 76 to fall downwardly through the holes 120 into the silt screen 48. The water will then pass through the apertures in the silt screen 48 and into the tank 24 for discharge or recirculation in the slurry as may be desired by the particular operator of the present invention.

Referring still to FIGS. 5 and 6, it will be observed that inlet pipe 36 opens into a throat 122 in bottom pan 46. Throat 122 is defined by a surface 124 that slopes inwardly from a substantially flat, disk-like surface 126. Bottom pan 46 further includes an outwardly sloping surface 128 that slopes from the surface 126, which is elevated above the surface 130 in which groove 116 is formed, to the substantially planar surface 130. The outwardly sloping surface 128 functions to ensure that the bottom end of the perforated screen 68 remains circular or substantially circular during operation and also functions to ensure that the screen 68 is centered vertically about the rotor 78 during operation. Finally, the bevel surface 128 aids in the attachment of the bottom pan 46 to the canister bottom plate 90 in that the screen will tend to sag slightly downwardly at its lower end when the dryer section is pivoted open as shown in FIGS. 7 and 8. As such, when the bottom pan 46 is attached to the bottom plate 90, the surface 128 will aid in centering the lower end of the screen 68 about the throat 122, and thus about the rotor 78. That is, as the screen's lower end on its uppermost side 132 sags slightly downwardly, its engagement with the beveled surface 128 of bottom pan 46 will cause the lower end 132 to be raised and thus the screen 48 to be aligned with the rotor 78.

It will also be observed that the bottom pan includes a circular, downwardly depending flange 134 that traps the substantially upright, cylindrically configured member 58 of silt screen 48 between it and the opening 62 in the top tank plate 64. Referring specifically to FIG. 6, it will be observed that the lower end of the perforated screen 68 engages the bottom pan 46 outwardly of the throat 122 and specifically outwardly of the surface 126. This engagement is not fixed, however, allowing ready removal of the screen for cleaning, repair, or replacement.

Figure 4:
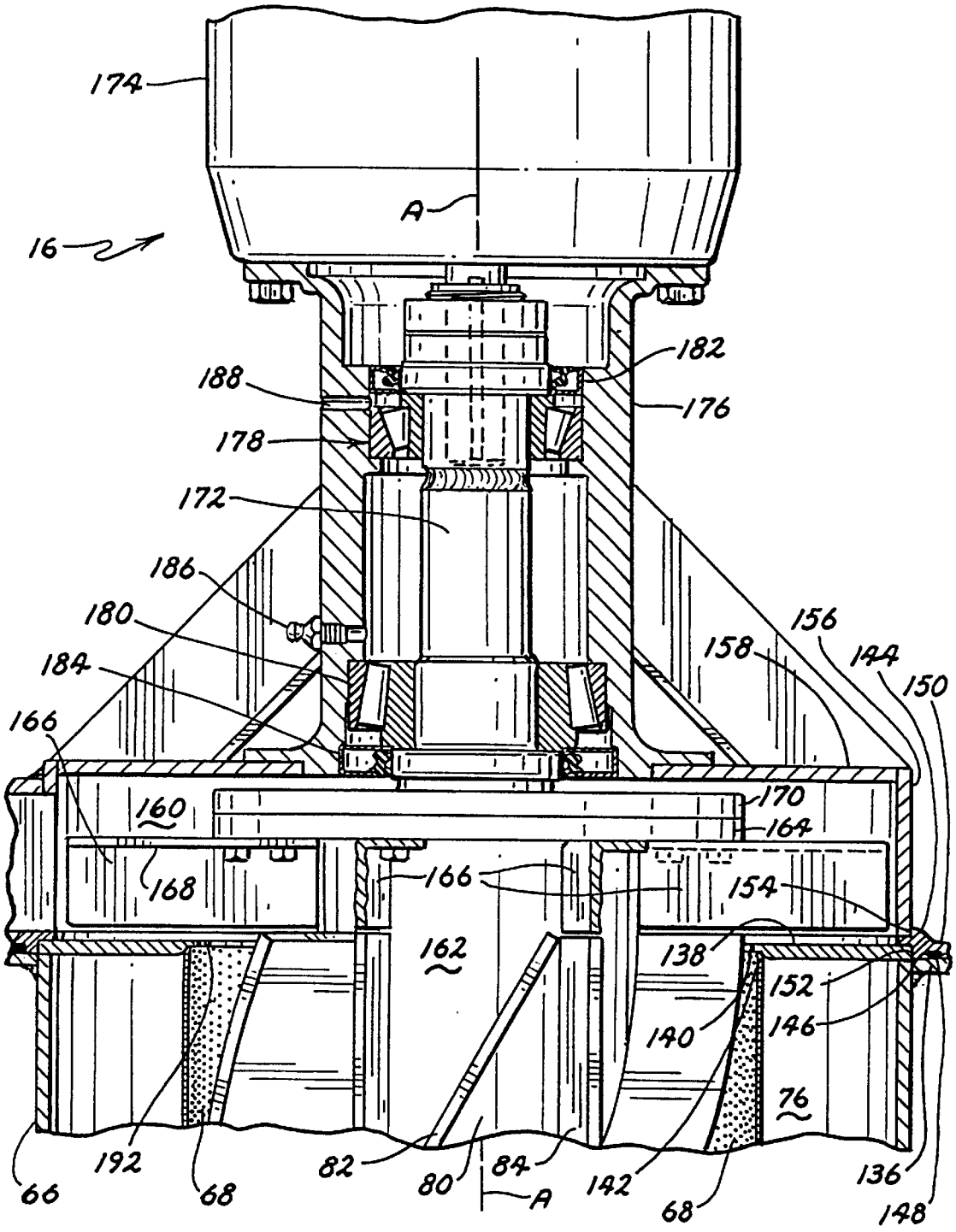
FIG. 4 is a side elevation, cross sectional view of the motor and shaft section or portion of the invention shown in FIG. 1.

Referring now to FIGS. 1, 2 and 4 principally, the upper end of the dryer section 14 and the motor section 16 will be described. Attached to the uppermost end of the canister 66 in a known manner such as welding is a canister top plate 136. Canister top plate 136 extends circumferentially thereabout and is used to facilitate the attachment of the motor section 16 to the dryer section 14 as will be pointed out hereafter. Canister 66 also includes a screen positioning plate 138, which has an inner flange 140 and associated screen positioning shoulder 142 that engages the upper end of the screen 68 and serves to center the screen circularly about the rotor 78. Screen positioning plate is in turn located and held in place on the top of the canister 66 by means of a positioning member 144 that is fastened or otherwise attached to the canister top plate 136 in any known manner, such as bolting as seen in FIG. 3, acceptable for the use of the present invention. As best seen in FIG. 4, positioning member 144 includes a groove 146 that receives a sealing member 148. Member 144 further includes an inwardly directed flange 150 that defines in part an inwardly directed lower shoulder 152 that cooperates with the flange 146 to seat and position the screen positioning member 138.

Member 144 and thus flange 150 further define an upper, inwardly directed shoulder 154 that seats a side plate 156 of the motor section 14. The side plate 156 has a substantially cylindrical configuration, except where it opens to the product discharge chute 20 as will be described further below. The side plate 156 in turn mounts a seal top plate 158 having a substantially disk-like configuration.

The plates 156 and 158 together with the screen positioning plate 144 define a volume 160 into which the upper end 162 of the rotor 78 extends. the uppermost end of the rotor pipe 80 is attached to a rotor top plate 164 in any known manner acceptable for the use of the invention herein, such as by welding or bolting. A plurality of scraper blades 166 are attached thereto. Each scraper blade 166 has an L-shaped configuration and can be attached to the rotor top plate 164 with bolts that extend through appropriate apertures in the horizontally extending portion 168 into apertures in the rotor top plate 164 as shown in the Figure. In operation the scrapers serve to remove and prevent a build up of product on the side plate 156 and to force the dried product into the discharge chute 20. Five scraper blades 166 are contemplated by the present invention, each scraper blade being in alignment with a kicker 84 and an end plate blade 88, though varying numbers of the foregoing could be used in accord with the present invention.

The rotor top plate 164 is attached to a rotor shaft plate 170 in a known manner such as with bolts inserted into recessed apertures, not shown, in the plates. The rotor shaft plate 170 is attached to the rotor shaft 172, which is driven by a motor 174 mounted on a bearing housing 176. It will thus be observed that the rotor 78 is mounted for rotation at only the upper end thereof. The rotor shaft 172 is mounted for rotation within the bearing housing 176 by a pair of bearings 178, 180, with both bearings 178 and 180 being of the tapered roller type. The bearings 178, 180 are sealed within the bearing housing 174 by top and bottom seals 182, 184. A grease fitting 186 is provided for providing appropriate lubrication to the bearings, with an overflow 188 being provided above the upper bearing 178. Also shown in the Figures are supporting motor struts or gussets 190 that strengthen and stabilize the bearing housing 176 and thus the motor 174 during operation.

OPERATION OF THE PRESENT INVENTION

With the foregoing description of the present invention, its operation can now be fully explained. A slurry will be fed through the inlet pipe 18 into the reservoir 12 and upwardly directed through the throat 122 of the bottom pan 46. The slurry, as noted, will comprise a desired end product and a fluid, most often water. The slurry will engage the bottom end plate blades 88, which will "throw" or force the slurry outwardly against the perforated screen 68. As the product strikes the screen 68, the water will be forced therefrom and will be forced through the apertures in the perforated screen 88 into the volume 76 by the centrifugal action of the water that is created by the rotating rotor 78. Once the water has entered the volume 76 through the perforations in the screen 68 it will fall downwardly within the volume 76 through the water discharge holes 120 and thus into the tank 24 of the reservoir section 12. As previously noted, the water in the tank 24 will flow from the tank via the discharge 22 and can be recirculated or treated as necessary before discharge into the appropriate water treatment or sanitary sewer system. The product, which may as previously noted, comprise raw plastic beads or spherules will be forced upward through the rotating action of the blades 82 attached to the rotor pipe 80. The product will alternately be forced against the screen 68 and bounce off of it back towards the rotor pipe 80. In this manner, then, the beads or other product appropriate for drying with an invention such as that described herein "bounce" its way upwards in the volume defined between the screen 68 and the rotor 78 until it reaches the area of the scraper blades 166. As the product passes upward into the volume 160 through the opening 192 in the screen positioning plate 138, the product will be engaged by the scraper blades 166, or the air streams created by their rotation, and then will be forced out of the dryer section 14 through the product discharge chute 20 into the appropriate receiving facility. In this manner product can be dried for later shipment to purchasers of the product.

When the perforations in the screen 68 become sufficiently plugged or the screen or other portion of the present invention 10 becomes damaged or otherwise in need of repair or replacement, the locking clamps 114 can be released and the dryer section tipped backwards away from the tank 24 about its pivotal connection thereto. Such as action will expose the bottom pan 46 as shown in FIG. 8. The silt screen 48 can be removed for cleaning or repair if desired at this time. If maintenance interior to the canister is desired, the bottom pan 46 can be rotated until the heads 104 of the locator pins 100 are aligned with the insertion portions 108 of the locking apertures 106, at which time the bottom pan 46 can be pulled away from the canister bottom plate 90 to expose the interior of the canister 66. The screen 68 can be removed for cleaning, repair, or replacement as desired. Because the screen 68 is trapped between the screen positioning plate 138 and the bottom pan 46 during operation, no tools are required to either remove or replace a clogged or damaged screen. Maintenance of both the silt screen 48 and the perforated screen 68 are thus simplified over prior art screens.

A further improvement over prior art centrifugal dryers is the rotational attachment of the rotor 78 at a single end thereof, which as shown in the Figures is at the rotor upper end 162. Prior art rotors in centrifugal dryers were all rotationally supported at both ends thereof. It has been found that this conventional, known way of attaching rotors within centrifugal dryers creates difficulties in servicing the components interior to the dryer canister by requiring tools to access the screen and the rotor itself for servicing when needed. As seen in FIG. 4 particularly, the rotor 78 is suspended by means of the rotor top plate 164 from its attachment to the rotor shaft plate 170, which in turn is attached to the motor shaft 172. Because there is no attachment of the rotor 78 at the other, lowermost end thereof to any other part of the present invention, removal of the bottom pan 46 can be done without tools, as previously noted, and upon removal will fully and completely expose the interior of the canister 66 for service.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed is:

1. A centrifugal dryer for drying product, said dryer comprising:

a reservoir section;

a dryer section; and a motor section;

wherein said dryer section is hingedly attached to said reservoir section of said centrifugal dryer.

2. The dryer of claim 1 wherein said reservoir section comprises a reservoir top plate, said dryer section being hingedly attached to said top plate.

3. The dryer of claim 2 wherein said reservoir section includes a tank having a top plate, said top plate including a pair of spaced apart hinge ears attached thereto, each hinge ear having a hinge aperture therein;

said dryer section includes a canister having a canister bottom plate, said canister bottom plate including a hinge tube receivable between said hinge ears; and said dryer further including a hinge rod received by said hinge tube and said hinge apertures, whereby said dryer section may be pivoted away from said reservoir section by said hinged attachment between said tank top plate and said canister bottom plate to provide access to said canister for maintenance, cleaning and repair.

4. The dryer of claim 3 wherein said dryer section comprises a canister having a canister bottom plate mounted thereto and a perforated screen mounted therein, said dryer section further comprising a bottom pan, said bottom pan being removably attached to said canister bottom plate.

5. The dryer of claim 4 wherein said dryer section further comprises a rotor defining an axis of rotation and a screen positioning plate, said screen positioning plate being provided for positioning said perforated screen circularly about said axis of rotation.

6. The dryer of claim 5 wherein said bottom canister bottom plate mounts a plurality of locator pins and said bottom pan includes a plurality of locating apertures configured to receive said locator pins and removably attach said bottom pan to said canister bottom plate.

7. The dryer of claim 6 wherein said locating apertures each include an insertion portion and a slot portion and wherein said bottom pan is removably mounted to said canister bottom plate by aligning said locator pins with said insertion portions and rotating said bottom pan relative to said canister bottom plate such that said locator pins are received within said slot portions of said locating apertures.

8. The dryer of claim 7 wherein said bottom pan includes a throat disposed substantially in the center thereof, said throat providing a central access to the interior of said canister for a slurry containing said product to be dried.

9. The dryer of claim 7 wherein said reservoir section includes a tank supporting said dryer section and said motor section and an inlet pipe for providing the slurry to said dryer section, said inlet pipe being received by said bottom pan such that the slurry is provided to said throat.

10. The dryer of claim 2 wherein said dryer section comprises a canister having a canister bottom plate and having a perforated screen mounted therein, said dryer section further comprising a bottom pan, said bottom pan being removably attached to said canister bottom plate.

11. The dryer of claim 10 wherein said dryer section further comprises a rotor defining an axs of rotation and a screen positioning plate, said screen positioning plate being provided for positioning said perforated screen circularly about said axis of rotation.

12. The dryer of claim 11 wherein said bottom canister bottom plate mounts a plurality of locator pins and said bottom pan includes a plurality of locating apertures configured to receive said locator pins and removably attach said bottom pan to said canister bottom plate.

13. The dryer of claim 12 wherein said locating apertures each include an insertion portion and a slot portion and wherein said bottom pan is removably mounted to said canister bottom plate by aligning said locator pins with said insertion portions and rotating said bottom pan relative to said canister bottom plate such that said locator pins are received within said slot portions of said locating apertures.

14. The dryer of claim 13 wherein said bottom pan includes a throat disposed substantially in the center thereof, said throat providing a central access to the interior of said canister for a slurry containing said product to be dried.

15. The dryer of claim 14 wherein said reservoir section includes a tank supporting said dryer section and said motor section and an inlet pipe for providing the slurry to said dryer section, said inlet pipe being received by said bottom pan such that the slurry is provided to said throat.

16. The dryer of claim 10 wherein said bottom pan includes a throat disposed substantially in the center thereof, said throat providing access to the interior of said canister for a slurry containing said product to be dried.

17. The dryer of claim 16 wherein said reservoir section includes a tank supporting said dryer section and said motor section and an inlet pipe for providing the slurry to said dryer section, said inlet pipe being received by said bottom pan such that the slurry is provided to said throat.

18. The dryer of claim 1 wherein said dryer section includes:

a canister having a substantially cylindrical configuration and a canister longitudinal axis;

an upper screen positioning plate attached to the upper end of said canister;

a lower screen positioning plate attached to the lower end of said canister; and a perforated screen having a substantially cylindrical configuration and a screen longitudinal axis, said screen being trapped between said screen positioning plates and positioned thereby such that said screen longitudinal axis is substantially co-linear with said canister longitudinal axis.

19. The dryer of claim 1 and further including a silt screen, said silt screen being removably disposed within said reservoir section.

20. The dryer of claim 19 wherein said reservoir section comprises a reservoir top plate, said dryer section being hingedly attached to said top plate.

21. The dryer of claim 20 wherein said reservoir section includes a tank having a top plate, said top plate including a pair of spaced apart hinge ears attached thereto, each hinge ear having a hinge aperture therein;

said dryer section includes a canister having a canister bottom plate, said canister bottom plate including a hinge tube receivable between said hinge ears; and said dryer further including a hinge rod received by said hinge tube and said hinge apertures, whereby said dryer section may be pivoted away from said reservoir section by said hinged attachment between said tank top plate and said canister bottom plate to expose the tank and said silt screen for access for maintenance, cleaning and repair thereof.

22. The dryer of claim 21 wherein said silt screen comprises an outer cylindrical portion having an outwardly extending flange thereon, said flange supporting said silt screen within said tank by engaging the upper surface of said tank top plate.

23. The dryer of claim 22 wherein said silt screen includes an inner cylindrical portion configured to receive an inlet pipe providing slurry to said dryer section and further includes an outwardly and downwardly sloping screen portion extending between said inner and outer cylindrical screen portions.

24. The dryer of claim 1 wherein said canister:

rotatably mounts a rotor having a longitudinal axis therein and a plurality of rows of blades mounted thereto; and mounts a perforated screen circumferentially about said rotor, and wherein a slurry is provided to said canister by an inlet pipe opening into said canister along said rotor longitudinal axis, wherein the slurry includes a product to be dryed and a fluid, the product moving upwardly within the volume defined between the rotor and the screen to a product discharge chute disposed above said canister and the fluid passing through apertures in the screen and falling downwardly in the volume defined between said screen and said canister into said reservoir section.

25. The dryer of claim 24 wherein said motor section includes a motor for rotatably driving said rotor.

26. The dryer of claim 1 wherein said dryer section comprises:

a canister having a canister bottom plate and having a perforated screen mounted therein;

a bottom pan, said bottom pan being removably attached to said canister bottom plate;

a rotor defining an axis of rotation and having an attachment end and a free end;

and wherein said motor section comprises:

a motor and a motor shaft, wherein said rotor attachment end is attached to said motor shaft so as to rotationally drive said rotor and said rotor free end rotates freely.

27. The dryer of claim 26 wherein said dryer section comprises a screen positioning plate, said screen positioning plate being provided for positioning said perforated screen circularly about said axis of rotation.

28. A centrifugal dryer for drying product, said dryer comprising:

a reservoir section;

a dryer section; and a motor section;

and wherein said dryer section comprises:

a canister having a canister bottom plate and having a perforated screen mounted therein;

a bottom pan, said bottom pan being removably attached to said canister bottom plate;

a rotor defining an axis of rotation and having an attachment end and a free end;

and wherein said motor section comprises:

a motor and a motor shaft, wherein said rotor attachment end is attached to said motor shaft so as to rotationally drive said rotor and said rotor free end rotates freely.

29. The dryer of claim 28 wherein said reservoir section includes a tank having a top plate, said top plate including a pair of spaced apart hinge ears attached thereto, each hinge ear having a hinge aperture therein;

said dryer section includes a canister having a canister bottom plate, said canister bottom plate including a hinge tube receivable between said hinge ears; and said dryer further including a hinge rod received by said hinge tube and said hinge apertures, whereby said dryer section may be pivoted away from said reservoir section by the hinged attachment between said tank top plate and said canister bottom plate to expose the bottom and interior of said canister for access for maintenance, cleaning and repair.

30. The dryer of claim 28 wherein said dryer section further comprises a bottom pan, said bottom pan being removably attached to said canister bottom plate.

31. The dryer of claim 30 wherein said dryer section further comprises a rotor defining an axis of rotation and a screen positioning plate, said screen positioning plate being provided for positioning said perforated screen circularly about said axis of rotation.

32. The dryer of claim 31 wherein said bottom canister bottom plate mounts a plurality of locator pins and said bottom pan includes a plurality of locating apertures configured to receive said locator pins and removably attach said bottom pan to said canister bottom plate.

33. The dryer of claim 32 wherein said locating apertures each include an insertion portion and a slot portion and wherein said bottom pan is removably mounted to said canister bottom plate by aligning said locator pins with said insertion portions and rotating said bottom pan relative to said canister bottom plate such that said locator pins are received within said slot portions of said locating apertures.

34. The dryer of claim 33 wherein said bottom pan includes a throat disposed substantially in the center thereof, said throat providing a central access to the interior of said canister for a slurry containing said product to be dried.

35. The dryer of claim 34 wherein said reservoir section includes a tank supporting said dryer section and said motor section and an inlet pipe for providing the slurry to said dryer section, said inlet pipe being received by said bottom pan such that the slurry is provided to said throat.

* * * * *